United States Patent [19]

Fedele

[11] Patent Number: 4,575,717

[45] Date of Patent: Mar. 11, 1986

[54] LOGIC FOR INCREASING THE NUMBER OF PIXELS IN A HORIZONTAL SCAN OF A BIT MAPPING TYPE VIDEO DISPLAY

[75] Inventor: Nicola J. Fedele, South Brunswick Township, Middlesex County, N.J.

[73] Assignee: RCA Corporation, Princeton, N.J.

[21] Appl. No.: 558,372

[22] Filed: Dec. 5, 1983

[51] Int. Cl.[4] ..... G09G 1/00

[52] U.S. Cl. ..... 340/728; 340/749; 340/723; 340/799; 340/731

[58] Field of Search ..... 340/720, 728, 731, 735, 340/744, 750, 798, 799, 749, 723

[56] References Cited

U.S. PATENT DOCUMENTS

| | | | |
|---|---|---|---|
| 3,293,614 | 12/1966 | Fenimore et al. . | |
| 4,079,458 | 3/1978 | Rider et al. | 340/728 |
| 4,081,799 | 3/1978 | Granberg et al. | 340/799 |
| 4,238,774 | 12/1980 | Lehman | 340/728 |
| 4,250,502 | 2/1981 | Klauck et al. | 340/728 |
| 4,308,532 | 12/1981 | Murphy | 340/750 |
| 4,357,604 | 11/1982 | Imazeki et al. . | |
| 4,367,533 | 1/1983 | Wiener . | |
| 4,383,296 | 5/1983 | Sander | 340/799 |
| 4,435,703 | 3/1984 | Hunt et al. | 340/749 |
| 4,439,762 | 3/1984 | Van Vliet et al. | 340/728 |
| 4,479,119 | 10/1984 | Sakano | 340/749 |
| 4,528,561 | 7/1985 | Kitamura | 340/728 |

*Primary Examiner*—Gerald L. Brigance

*Attorney, Agent, or Firm*—Joseph S. Tripoli; Robert L. Troike; William H. Meise

[57] ABSTRACT

A circuit (FIG. 2), for use with a basic display system (FIG. 1), increases by an integral factor M the number (X) of character pixels per display line without changing the rates of clock pulse trains ($S_x(f_x)$, $S_1(f_1)$) provided by a timing system (114, 116) resident in the basic system. The circuit increases by the factor M both: (a) the rate at which N-bit words are retrieved serially from the basic system's memory means and (b) the rate at which bits of those of the words, whose bits represent pixels of characters within a scan line, are converted into a stream of MX bits. In one embodiment, M equals 2.

3 Claims, 10 Drawing Figures

LOGIC FOR INCREASING THE NUMBER OF PIXELS IN A HORIZONTAL SCAN OF A BIT MAPPING TYPE VIDEO DISPLAY

This invention relates generally to video display architecture in a microcomputer system and more particularly to an improved video display architecture which can double or quadruple the number of pixels in a horizontal scan of a bit mapping type video display without increasing the basic timing of the system.

Most present day video display architectures employed in present day video games, for example, embody a 40 character per line format due to the display limitations of most current television sets with which the games are used. However, when dealing with products such as a home computer, it becomes necessary to consider a design that can display 80 characters per horizontal line on a special CRT monitor with suitable bandwidth. A problem arises in that the pixel rate for displaying 80 characters per horizontal line, as compared with 40 characters, per line is different. Specifically, the pixel rate for displaying 80 characters per line is twice that required for displaying 40 characters per line. The prior art solution to this problem is to provide logic in the base system hardware which will switch clock speeds in accordance with whether the 40 or the 80 character per line format is desired. The foregoing conventional technique requires that the pixel rate generated in the base system hardware for an 80 character per line format be twice that required for a 40 character per line format. Such a solution requires extensive additional hardware in the design of the base system hardware in that many of the components must be required to operate at twice the speed in an 80 character format as in a 40 character format. Such increase in the demands of the hardware of the base system is reflected in a higher price for a product in a highly competitive market.

A primary purpose of the present invention is to provide a minimum amount of logic external to the base system hardware which will enable the system to generate pixels at twice the rate as the base system hardware, thereby doubling the number of characters per horizontal scan, but without changing the internal timing of the base system hardware.

In a preferred form of the invention there is provided, in a system having a base system main random access memory and a visual display means, control means including a resident timing system for generating pixels on said visual display means at a rate of X pixels per horizontal scan in response to a first train of clock pulses $S_x$ of repetition rate $f_x$, a circuit for doubling the rate of pixel generation and therefore the number of pixels per horizontal scan and comprising a first generator for generating a second train of clock pulses $S_x'$ of repetition rate $Mf_x$, a second generator responsive to every Nth pulse of $S_x'$ to generate a third train of clock pulses $S_1'$ of repetition rate $Mf_1$, and a delay for delaying said third train of pulses by a time interval $\Delta$ to generate a fourth train of clock pulses $S_4$ of repetition rate $Mf_1$, where $\Delta < 1/Mf_1$. Also provided are first and second shift registers, a third generator means for generating N bit pixel-representing data words, and switching logic for alternately supplying an N bit pixel-representing data word in parallel to the first and second shift registers on successively occurring clock pulses of $S_4$. The first and second shift registers are each responsive to N successive clock pulses of $S_x'$ following alternate clock pulses of $S_1'$, and during the time period that a data word is being supplied in parallel to the other of the first and second shift registers, to serially shift therefrom the N bit data word stored therein.

In the drawings:

FIG. 1 is a block diagram of a prior art base system hardware architecture to which the present invention is essentially an add-on;

Figure 1:
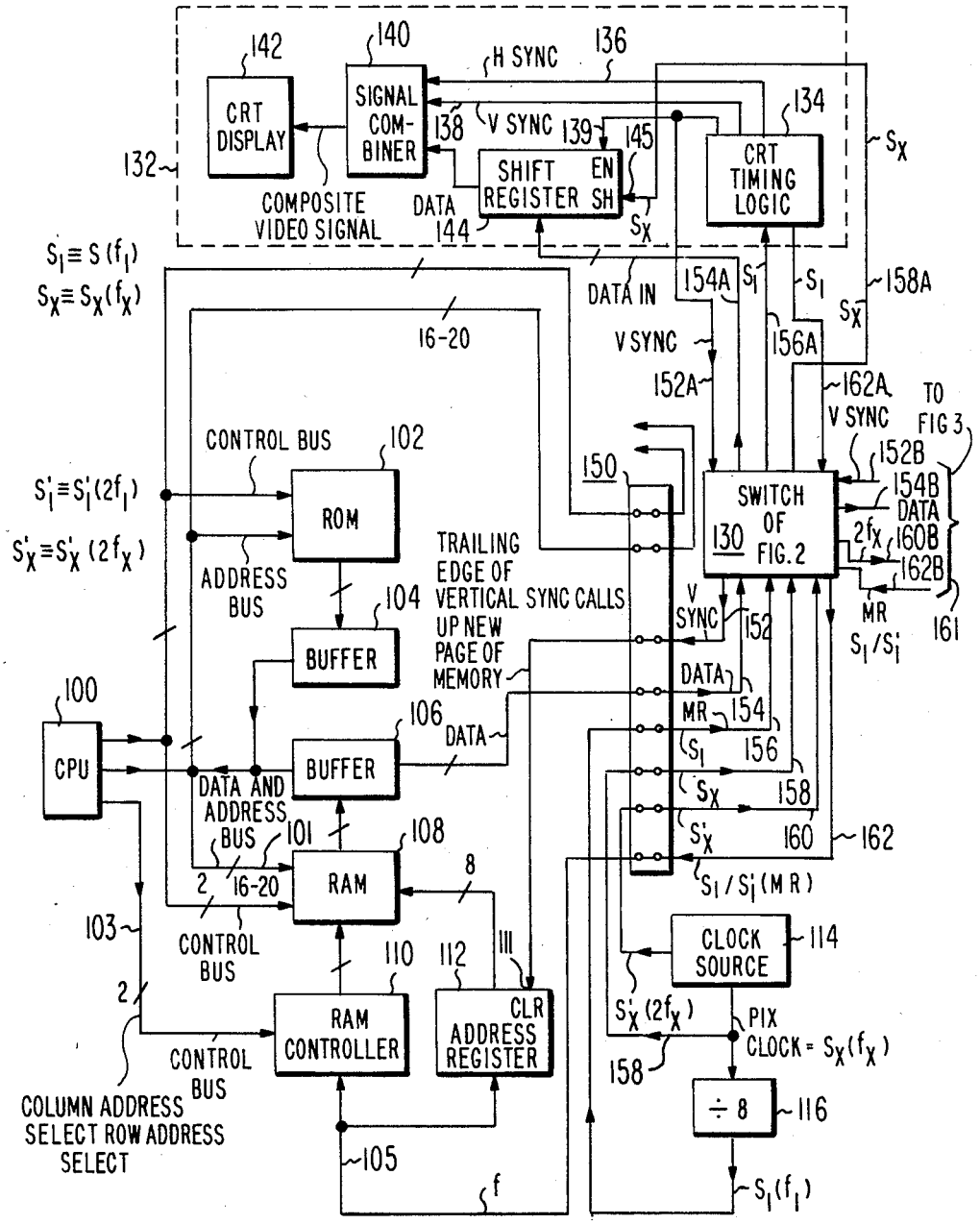
PRIOR ART Fig. 1

Referring to FIG. 1 there is shown a block diagram of a typical prior art architecture for a data processing system employing a cathode ray tube (CRT) read-out display 142, and further employing a dot matrix technique for the CRT display.

The structure of FIG. 1 is included in the specification to provide the reader with a background of typical present day architectures of computer systems employing dot matrix type readouts so that the environment in which the present invention is employed can be better understood.

In FIG. 1, a central processing unit (CPU) 100 cooperates via buffer 104 with an internal ROM 102 which contains internal housekeeping programs necessary to execute various application programs such as a display of characters on CRT 142. Random access memory (RAM) 108, which can be a dynamic RAM (DRAM) is under control of RAM controller 110 and word location addresses supplied via 16–20 lead bus 101 from CPU 100 to supply the contents of accessed (addressed) word locations to a buffer 106. More specifically RAM 108 is normally divided into a plurality of sections each addressable by an address supplied thereto via address bus 101. The two control leads comprising bus 103 determine whether a column address or a row address is being selected. The memory request (MR) signal $S_1$ of frequency $f_1$ appearing on input lead 105 and supplied to RAM controller 110 and address register 112 functions to increment the address selected by the address on bus 101 at the end of each 8-bit byte read out of RAM 108 into buffer 106. Such 8-bit byte is supplied to the CRT display logic 132 via switch 130 where the individual eight bits of each byte control the on/off condition of the electron beam as it scans across the CRT screen. Such 8-bit bytes are supplied continuously to display logic 132 in a conventional and well known manner to create a bit map on the CRT screen. Reference is made to U.S. Pat. No. 3,239,614 issued to Fenimore, et al. for a detailed explanation of the bit mapping technique.

Figure 3:
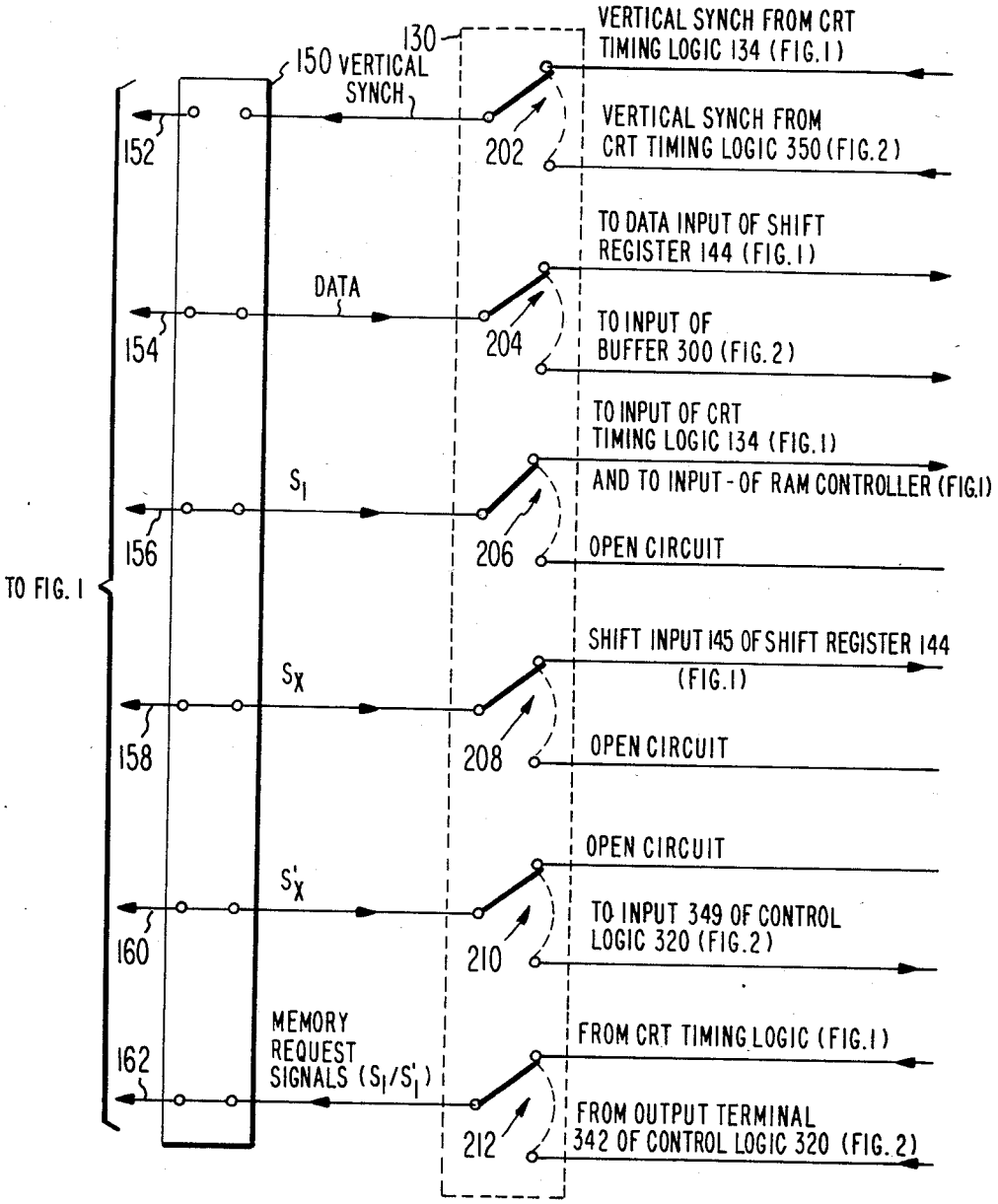
FIG. 3 shows switching logic for substituting the logic of FIG. 2 for a portion of the logic of FIG. 1 to thereby double the number of pixels (and characters) that can be displayed in one horizontal scan by the system.

It should be noted at this point that switch 130, which is shown in detail in FIG. 3, functions in a first mode to connect certain of the terminals of external bus terminal 150 therethrough to certain points in the CRT display control logic 132. More specifically, when switch 130 is in its first mode the lead 152 is connected to lead 152A, lead 154 is connected to data lead 154A, memory request lead 156 which carries $S_1$ is connected to lead 156A, and lead 158, which carries the pixel clock signal $S_x$ of frequency $f_x$, is connected to lead 158A, and a return memory request lead 162 is connected to lead 162A.

It should be noted that lead 156 supplies the memory request signals as they are generated at the output of frequency divide-by-eight logic 116, to logic 132 of FIG. 1 via lead 156A where they are employed to generate the horizontal and vertical synchronizing pulses which are supplied therefrom to signal combiner 140.

The MR signal $S_1$ of frequency $f_1$, however, are supplied back through switch 130, when in its first mode, and to the inputs of controller 110 and address register 112. Such MR signals $S_1$ constitute the only memory request signals when the switch 130 is in its first mode.

For purposes of brevity the signals $S_1$ and $S_x$ of frequencies $f_1$ and $f_x$, and also signals $S_1'$ and $S_x'$ of frequencies $2f_1$ and $2f_x$, will be referred to herein as $S_1(f_1)$, $S_x(f_x)$, $S_1'(2f_1)$, and $S_x'(2f_x)$ or simply as signals $S_1$, $S_x$, $S_1'$, and $S_x'$.

Figure 2:
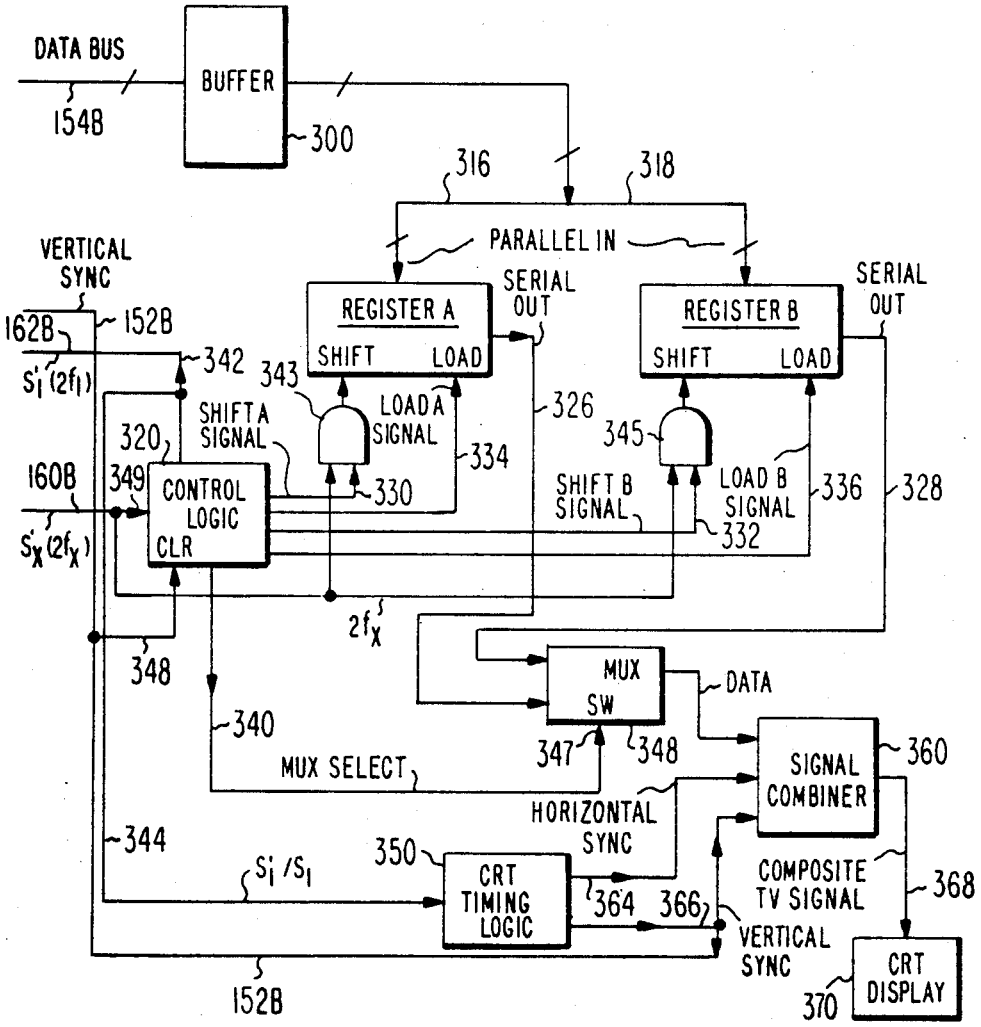
FIG. 2 is a block diagram of one form of the invention.

The switch 130, when in its second mode, will extend only leads 152, 154, 160 and 162 therethrough to the logic of FIG. 2 as leads 152B, 154B, 160B, and 162B. Thus, in summary, when in its second mode, switch 130 disconnects all of the leads extending from external bus terminal 150 to the logic 132 of FIG. 1 and, in fact, substitutes the logic of FIG. 2 for the logic 132, as will be discussed in detail later herein.

Referring now to the logic within block 132 of FIG. 1, the train of MR pulses $S_1$ is supplied from the output of divide-by-eight divider 116 through external bus terminal 150 and switch 130 to the input of CRT timing logic 134 via lead 156A. The CRT timing logic 134 responds thereto to generate the horizontal and vertical sync pulses required to control the electron beam of the CRT display device 142. Such horizontal and vertical sync pulses are, however, first supplied to signal combiner 140 via output leads 136 and 138 along with data from shift register 144 to form a composite TV signal.

The data supplied from shift register 144 originates from the accessing of the contents of selected word locations of RAM 108 which are then supplied to buffer 106 and subsequently through external bus terminal 150 and switch 130 to the input of shift register 144. Such data is shifted out of shift register 144 under control of the pixel clock pulses $S_x(f_x)$ into combiner 140. Combiner 140 combines the data and the horizontal and vertical sync pulses to form a composite video signal which is then supplied to CRT display 142 to produce the desired display. The shifting-out of the data bytes in serial manner from shift register 144 is initiated by an enabling signal supplied from CRT timing logic 134 to the enable input 139 of shift register 144.

It can be seen from FIG. 1 that the pixel clock signal of frequency $S_x(f_x)$, generated at the output of clock source 114, is supplied via lead 158, external bus terminal 150, and switch 130 to the shift input (SH) 145 of shift register 144. The vertical sync pulses appearing on output lead 138 of CRT timing logic 134 are supplied via lead 152A, back through switch 130, external bus terminal 150, and lead 152 to the clear input 111 of address register 112. Thus, address register 112 will be cleared to zero value at each vertical synch pulse to insure that the data bytes accessed in RAM 108 remain synchronized with the vertical sync signals.

Up to this point the discussion has been directed to the prior art structure of FIG. 1. In order to convert the system into the present invention, switch 130 is activated to its second mode so that the logic of FIG. 2 is connected to the inputs of bus terminal 150 via leads 161 and switch 130. The logic within block 132 of FIG. 1 is simultaneously completely disconnected from the system.

As shown in FIG. 3, the switch 130 of FIG. 1 can be comprised of several individual switches such as the six individual switches 202, 204, 206, 208, 210 and 212, or their electronic equivalent, collectively identified as switch 130. The six switches 202 through 212 can be ganged or coupled together so that all of the switches will make with their upper contacts thereof (or the electronic equivalents) when in their first mode so that logic 132 of FIG. 1 is connected into the system and will make with their lower contacts when in their second mode to connect the logic of FIG. 2 into the system of FIG. 1.

It will be observed that the set of leads from external bus terminal 150 of FIG. 1 that is switched to logic 132 of FIG. 1 (the first mode of switch 130) is not the same set of leads that is switched to the logic of FIG. 2 (the second mode of switch 130). Thus, the leads 156 and 158 carrying the train of pulses $S_1(f_1)$ and $S_x(f_x)$ are supplied to logic 132 of FIG. 1 when switch 130 is in its first mode, but are not supplied to the logic of FIG. 2 when switch 130 is in its second mode, but rather are simply open circuits.

On the other hand the pixel clock signal $S_x'(2f_x)$ supplied to switch 130 via lead 160 is not supplied to the logic 132 when switch 130 is in its first mode but is supplied to the logic of FIG. 2 when switch 130 is in its second mode. The specific destinations of the various signals supplied from external bus terminal 150 to either the logic 132 of FIG. 1 or to the logic of FIG. 2 is clearly indicated in FIG. 3 and also in FIGS. 1 and 2 and will not be further itemized in the specification. Such signals and their destinations will, however, be discussed in the operation of the detailed discussion of each of the circuits of FIGS. 1 and 2.

It should be noted that the vertical sync pulses which are supplied back to the logic of FIG. 1 via switch 130 and lead 152 originate in the CRT logic 134 of FIG. 1 when switch 130 is in its first mode and in the CRT timing logic 350 of FIG. 2 when switch 130 is in its second mode.

While additional logic could be incorporated that would utilize the CRT timing logic 134 of FIG. 1 as the CRT timing logic 350 of FIG. 2, it is deemed expedient to use separate CRT timing logic in FIGS. 1 and 2 for purposes of simplicity of the specification and because certain timing differences do exist in the two CRT timing logic circuits 134 and 350.

When switch 130 is in its first mode, the memory request (MR) signals $S_1(f_1)$(FIG. 1) will be supplied in a circuit extending from divider 116, external bus 150, switch 130, CRT timing logic 134, and then back through switch 130 via lead lead 162, 162A, external bus terminal 150 and to inputs of controller 110 and address register 112 via lead 105. When switch 130 is in its second mode, the memory request signal $S_1'(2f_1)$ will be generated in control logic 320 of FIG. 2 and supplied back via lead 162B, switch 130, lead 162, and external bus 150 to the inputs of RAM controller 110 and address register 112 via lead 105. It should be noted that the memory request signal $S_1'$ generated in control logic 320 of FIG. 2 is in response to the double frequency pixel input signal $S_x'$ which is supplied to control logic 320 of FIG. 2 from clock source 114 of FIG. 1, external bus terminal 150, lead 160, switch 130, and lead 160B.

Referring now to FIG. 2, the circuits shown therein will be described in detail with the assumption that switch 130 is in its second mode of operation. The data is supplied from buffer 106 of FIG. 1 to external bus terminal 150, switch 130, and to the input lead 154B of buffer 300 of FIG. 2.

The double pixel clock signal $S_x'$ is supplied via lead 160B to the input of control logic 320 which will respond thereto to generate six output signals in a manner and for purposes to be described in more detail later herein in connection with the discussion of FIG. 5.

Figure 10:
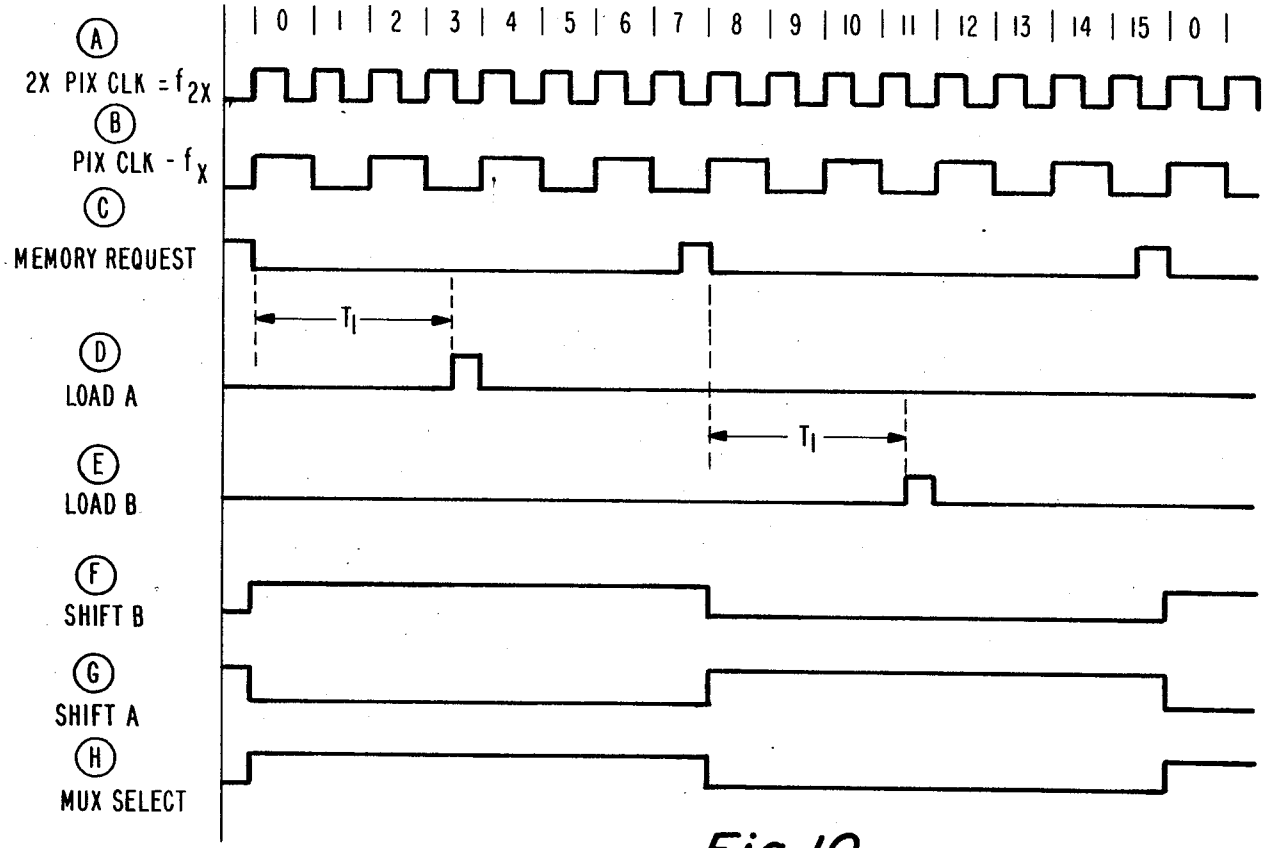
FIG. 10 is a set of timing waveforms showing the general timing of the invention as shown in FIGS. 2 and 6.

Assume for now that these six signals generated by control logic 320 in response to the input signal $S_x'$ are as follows. The memory request signal $S_1'$ (waveform 10C of FIG. 10 hereafter referred to as waveform 10C) is generated on output lead 342 and is supplied back to the controller 110 and the address register 112 of FIG. 1, as discussed above. The second and third output signals are the LOAD A and the LOAD B signals (waveforms 10D and 10E) generated on input leads 334 and 336 of shift registers A and B, respectively, in response to alternate occurrences of the memory request signal $S_1'$ of waveform 10C, as will be seen later from the discussion of FIG. 4. The fourth and fifth output signals are SHIFT A and SHIFT B signals (waveforms 10G and 10F) on output leads 330 and 332 from control logic 320 and which are supplied to shift registers A and B, respectively, through AND gates 343 and 345, when enabled. The SHIFT A and SHIFT B signals each consist of a sequence of N consecutive pulses of $S_x'(2f_x)$ (the pixel rate being $2f_x$) with such sequences being supplied alternately to shift registers A and B.

It will be noted that each of such sequences of N shift pulses is supplied to shift register A during the time period that a byte of data is being loaded in parallel into register B and that such sequences of shift pulses is supplied to register B during the time that a byte of data is being loaded in parallel into register A.

The sixth output signal generated by control logic 320 is the multiplex (MUX) select switching signal (waveform 10H) which is supplied to the switch input 347 of MUX 348. MUX 348 responds to this switching signal to alternately connect the outputs of shift registers A and B to signal combiner 360 during the alternate time periods that the contents of registers A and B are being serially shifted therefrom onto output leads 326 and 328.

Simultaneously, the memory request signal $S_1'$ is supplied to CRT timing logic 350, which has no direct timing relation with the SHIFT and LOAD pulses supplied to registers A and B. The CRT timing logic 350 responds thereto to generate horizontal and vertical sync pulses on its output leads 364 and 366 which are supplied to signal combiner 360 which in turn responds thereto to generate a composite output TV signal on its output lead 368. This composite TV signal is supplied to an appropriate CRT display 370. A vertical sync output pulse generated in CRT timing logic 350 is also supplied via lead 152B back through switch 130 of FIG. 1 and external bus terminal 150 to the clear input 111 of address register 112 to clear such address register at the beginning of each vertical sync pulse and thus maintain proper synchronization between the vertical sync and the bytes accessed from RAM 108.

Figure 4:
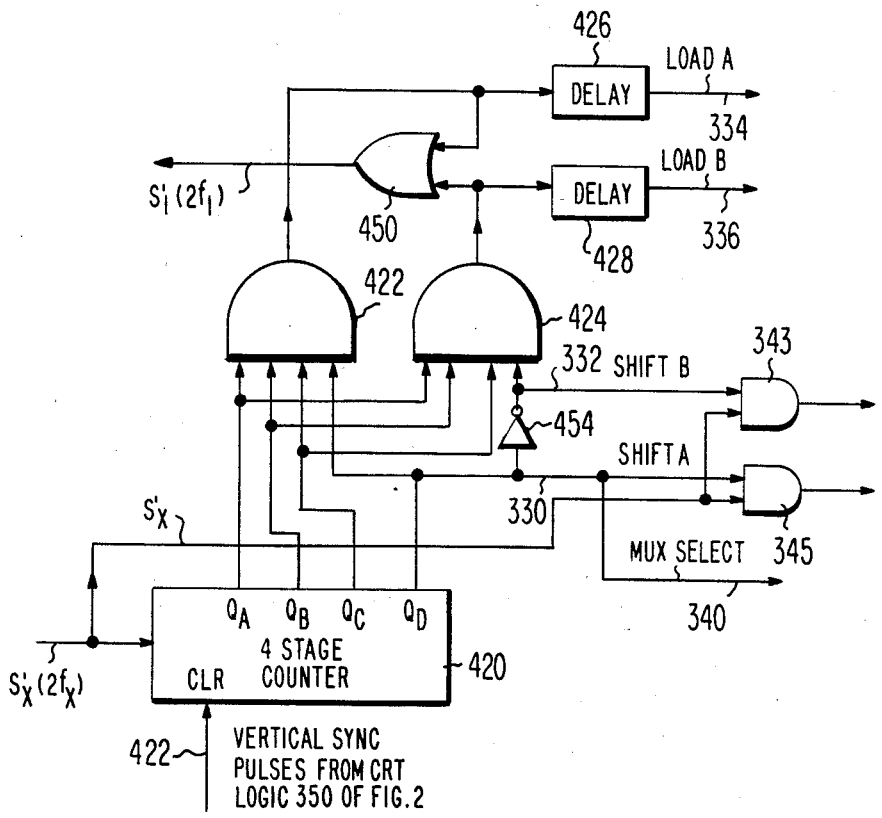
FIG. 4 is a combination block and logic diagram of the control logic 320 of FIG. 2.
Figure 5:
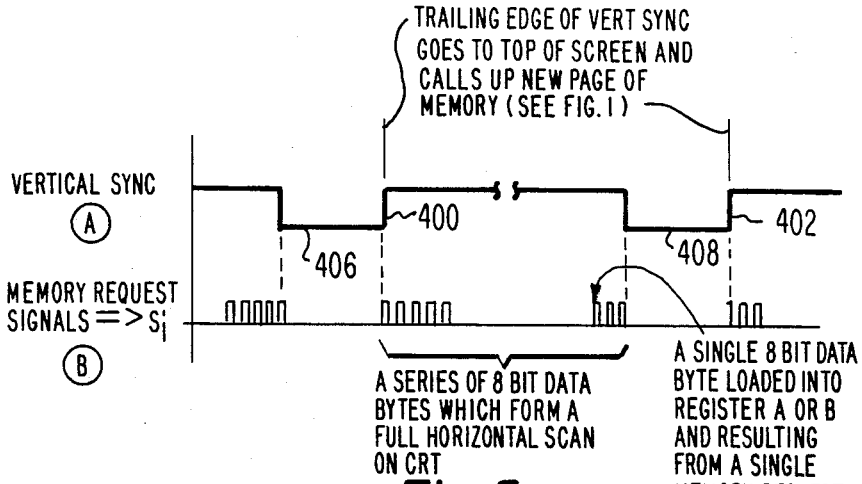
FIG. 5 is a set of two timing waveforms A and B showing the relationship between the vertical synchronizing pulses and the main memory request signals of the system.

The timing relationship between the vertical sync pulses and the pixel clock signal $S_x'$ is shown in FIG. 5. In FIG. 5, the positive trailing edge of each vertical sync pulse 406 or 408, such as the rising trailing edges 400 and 402, causes the CRT electron beam to go to the top of the screen and simultaneously recalls the page of memory from RAM 108 of FIG. 1 via address register 112 in order to refresh the display. Such trailing edges 400 and 402 of the vertical sync pulses also clear counter 420 of FIG. 4 via lead 422 to synchronize each group of eight shift pulses supplied from counter 420 with the beginning of the display of the new page of memory.

Referring now more specifically to FIG. 4, there is shown a detailed showing of the logic within control logic block 320 of FIG. 2. In FIG. 4 the pixel clock signal $S_x'$ is supplied to the input of four stage counter 420 which counts from zero through fifteen in binary manner with the instantaneous count appearing on its four output terminals $Q_A$, $Q_B$, $Q_C$, and $Q_D$. During the first eight counts from zero to seven the SHIFT B output signal on lead 332 will be at a high level as shown in waveform 10F due to the effect of inverter 454 which will invert the low level signal of output $Q_D$. During the counts of eight through fifteen, SHIFT A output signal on lead 330 will be a high level signal thereon since $Q_D$ will be at a high level. It will be noted that at the count of seven all four inputs to AND gate 424 will be high to produce a high level output signal from AND gate 424. Such high level signal will be supplied through delay means 428 to the LOAD B output lead 336 as a high level pulse. It is during this delayed high level output signal that register B of FIG. 3 is loaded with a byte from RAM 108 of FIG. 1. This byte appears in buffer 300 of FIG. 2 concurrently with the LOAD B pulse appearing on lead 336 of FIG. 4 and is entered in parallel in register B of FIG. 2.

At the count of fifteen, all four inputs to AND gate 422 (FIG. 4) are high level signals to supply a high level signal through delay means 426 and lead 334 to LOAD register A. Register A is loaded with the next byte accessed from RAM 108 of FIG. 1 which byte is in residence in buffer 300 at the time the LOAD register A pulse occurs.

The MR outputs of both AND gates 422 and 424 are supplied directly through OR gate 450 (FIG. 4), switch 130 (FIG. 1), and bus terminal 150 to the inputs of RAM controller 110 and address register 112. As discussed above, the outputs of AND gates 422 and 424 occur alternately at the counts of seven and fifteen of counter 420 as counter 420 counts through its zero to fifteen capacity. As mentioned above, these alternate pulses at the outputs of AND gates 422 and 424 are the memory request (MR) signals which are supplied back to controller 110 and address register 112 of FIG. 1 to control the accessing of the contents of successive memory locations of RAM 108.

A MUX select signal is generated on output lead 340 of FIG. 4. This MUX select signal is a high level signal for the counts of zero to seven of counter 420 and a low level signal for the counts of eight to fifteen of counter 420 and is represented by waveform 10H.

Figure 6:
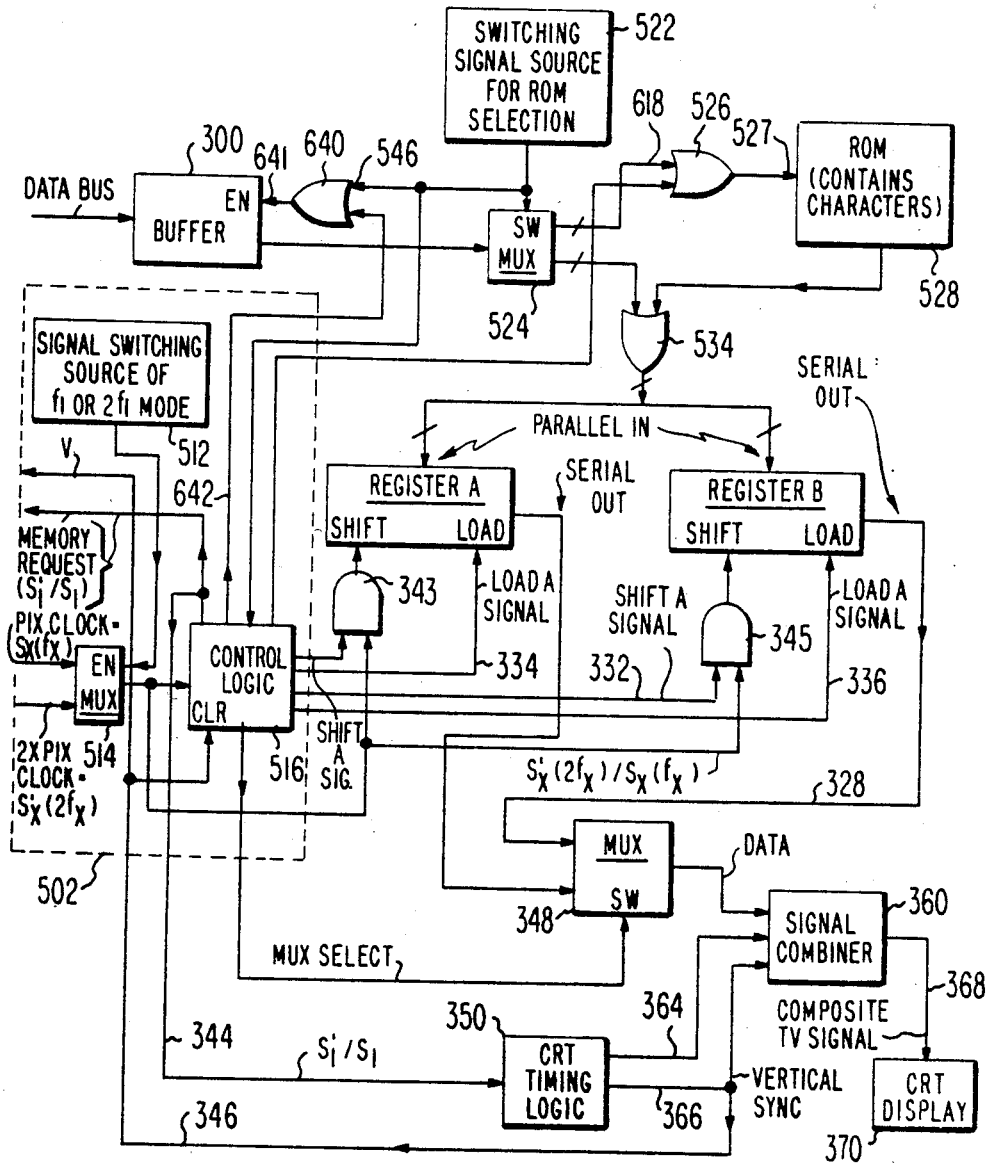
FIG. 6 is a combined block and logic diagram of another form of the invention.

Referring now to FIG. 6, there is shown a block diagram of another form of the invention. The structure of FIG. 6 is quite similar to that of FIG. 2 but with two important differences. The first difference is that the structure of FIG. 6 can process either the double frequency pixel clock signal $S_x'(f_{2x})$ to produce twice the characters horizontally across the screen or it can process the original pixel clock signal $S_x(f_x)$, both in lieu of the logic of block 132 of FIG. 1. Thus, the logic of FIG. 6 is, in essence, an all purpose logic to process either the original pixel clock pulse rate $f_x$ which will produce one memory access per horizontal scan, or it will process the pixel clock rate $2f_x$ to produce two memory requests per horizontal scan and thus double the number of characters that can be generated horizontally across the screen. The logic to perform this feature is included within the dotted block 502 which will be described later herein with respect to FIG. 7.

The second important difference is the logic within control logic 516 of FIG. 6 which enables the system to address characters contained in the ROM 528. More specifically, ROM 528 is, with other logic, a character generator and a single address from RAM 108 of FIG. 1 identifies the location of a character in ROM 528 which then functions to output the bytes required to form the entire bit matrix defining the character. These bytes are supplied alternately to shift registers A and B of FIG. 6 in generally the same manner as described above with respect to FIG. 4.

There is a relation between the logic within blocks 502 and 516 in that if a character is being accessed in ROM 528, which might consist of ten vertical line segments for example, then the memory access pulses will occur only one-tenth as frequently as when the ROM is not being used in the system, as is shown in FIG. 4. The control logic 516 will function to generate the memory request signals at the proper rate in response to an output from switching signal source 522 which functions to supply the pixel-representing data bytes accessed from RAM 108 of FIG. 1 either directly through MUX 524 and OR gate 534 to shift registers A and B of FIG. 6, or alternatively to access ROM 528 through OR gate 526 which then will supply pixel-representing data bytes to shift registers A and B.

Certain control signals are generated within control logic 516 which are supplied via OR gates 640 and 526 to the enable inputs 641 and 527 of buffer 300 and ROM 528, respectively. The enablement of buffer 300 occurs only at certain times when the system is in the ROM mode, as will be discussed in detail in connection with FIG. 7. It is necessary that ROM 528 be addressed directly from buffer 300 through OR gate 526 during part of the ROM mode of operation and also from a RAM 600 (FIG. 7) (not RAM 108 of FIG. 1) located in control logic 516 during the remainder of the ROM mode of operation. As will be discussed in detail later herein with respect to FIG. 7, the ROM addresses obtained from the RAM 108 of FIG. 1 to define the 80 characters are stored in RAM 600 and subsequently employed to access the proper word locations of ROM 528 to obtain the 6-bit pixel bytes for the remaining 9 lines of the 80 characters. Thus, there is a need for OR gate 526 which supplies both sources of ROM addresses to ROM 528.

Figure 7:
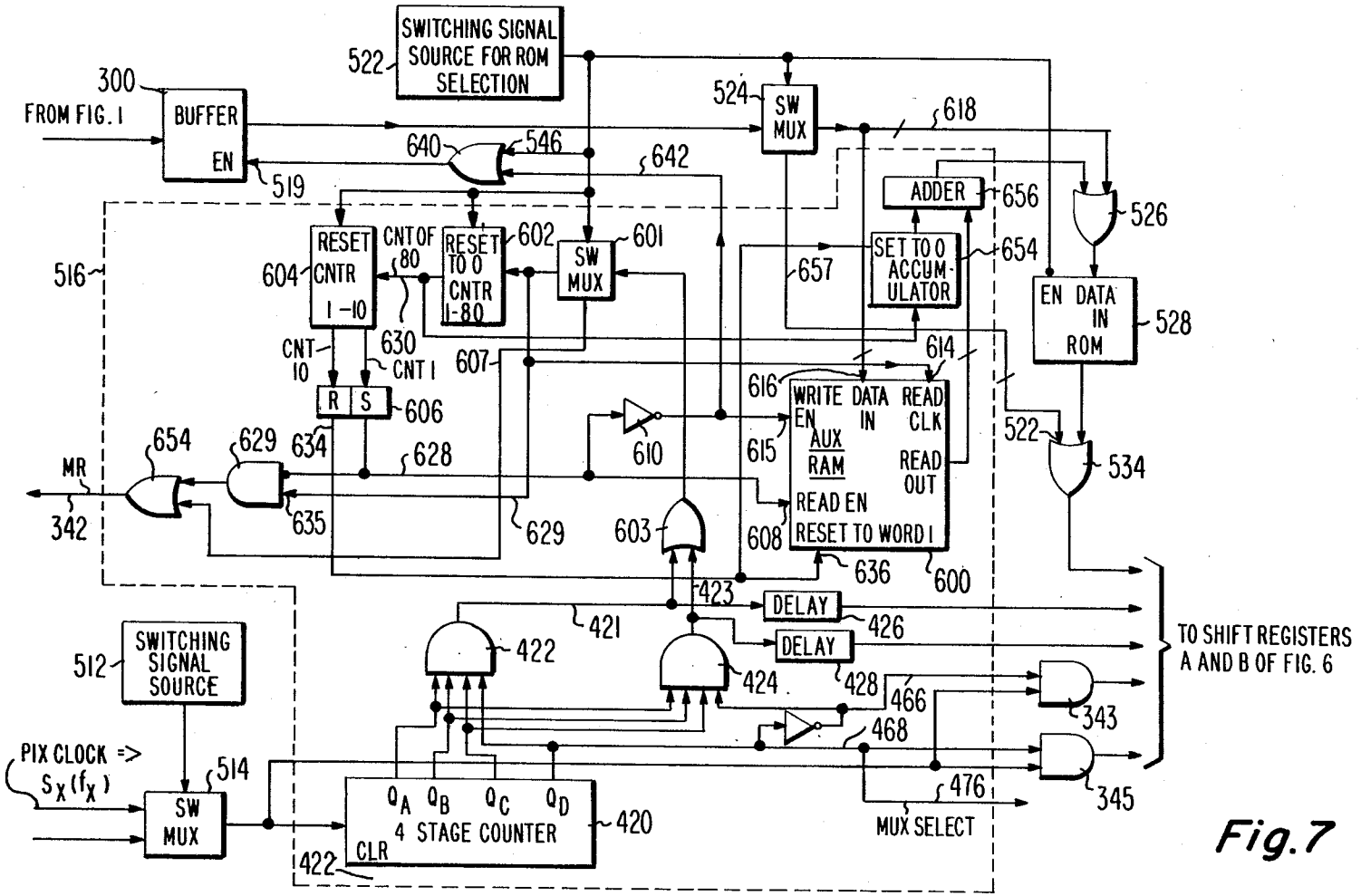
FIG. 7 is a detailed block and logic diagram of the control logic 516 of FIG. 6.

Referring now specifically to FIG. 7 there is shown a detailed diagram of the control logic 516 of FIG. 6. Also shown in FIG. 7 are buffer 300, OR gates 640, 534 and 526, MUX 524, ROM 528 and switching signal source 522, all of which are also shown in FIG. 6 and identified by the same reference characters. Other elements of FIG. 7 which form part of the detailed control logic within dotted block 516 of FIG. 7 have corresponding elements in FIG. 4 and are identified by the same reference characters. Such elements include AND gates 422, 424, 343, 345, OR gate 603, delay elements 426 and 428, switching signal source 512, MUX 514, and four-stage counter 420.

The last-mentioned elements operate in the same manner as the corresponding elements in FIG. 4 and their operation will not be again described.

As indicated generally in the discussion supra with respect to FIG. 6, the control logic 516 of FIG. 7 functions to place the system in one of four modes of operation. More specifically, when the switching signal from switching signal source 512 is at a first level it will cause the pixel clock signal $S_x$ to be supplied through MUX 514 to the input of four-stage counter 420 so that the system will operate on a 40 character per horizontal line basis. If the output of switching signal source 512 is at its second level, MUX 514 will pass the pixel clock signal $S_x'$ through MUX 514 to the input of four-stage counter 420 to cause the system to operate in an 80 character per horizontal line mode.

Both the 40 character mode and the 80 character mode per line mode of operation can utilize the data accessed directly from the main memory 108 of FIG. 1, or, alternatively, they can employ the data derived from the ROM 528 of FIG. 7. Thus, the four modes of operation of the system are defined.

As discussed briefly before, ROM 528 contains characters represented by dot matrices which can, for example, be six bits (dots) across horizontally and ten lines (dots) in the vertical direction. The logic of FIG. 7 functions to access the contents of a single word location in the RAM 108 of FIG. 1 for each of either the 40 or the 80 characters to be displayed across the top horizontal scan line of such characters. More specifically, the contents of each of these RAM 108 word locations defines the left-most pixel location of the top horizontal scan line of each character. The logic 516 will then function to automatically access from ROM 528 successive 6-bit bytes for the remaining nine rows of dots (stacked vertically one above the other) for each of the characters to be displayed across the 40 or 80 character display. Thus, to display a row of 80 characters across the display screen, it is necessary to access only 80 memory locations, each only a single time, in the main RAM 108 of FIG. 1. The contents of each of these 80 memory locations defines the location of the single upper left hand pixel of each of the 80 characters to be displayed.

Figure 9:
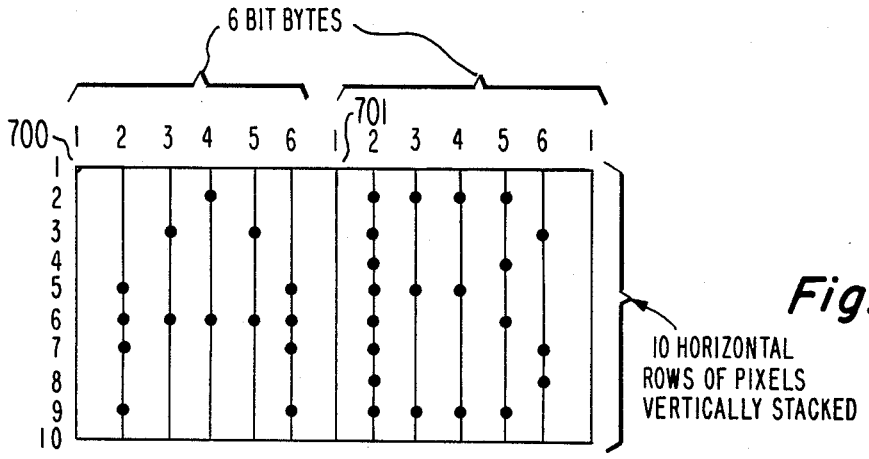
FIGS. 8 and 9 show the format of producing characters on a display screen employing a dot matrix technique.
Figure 8:
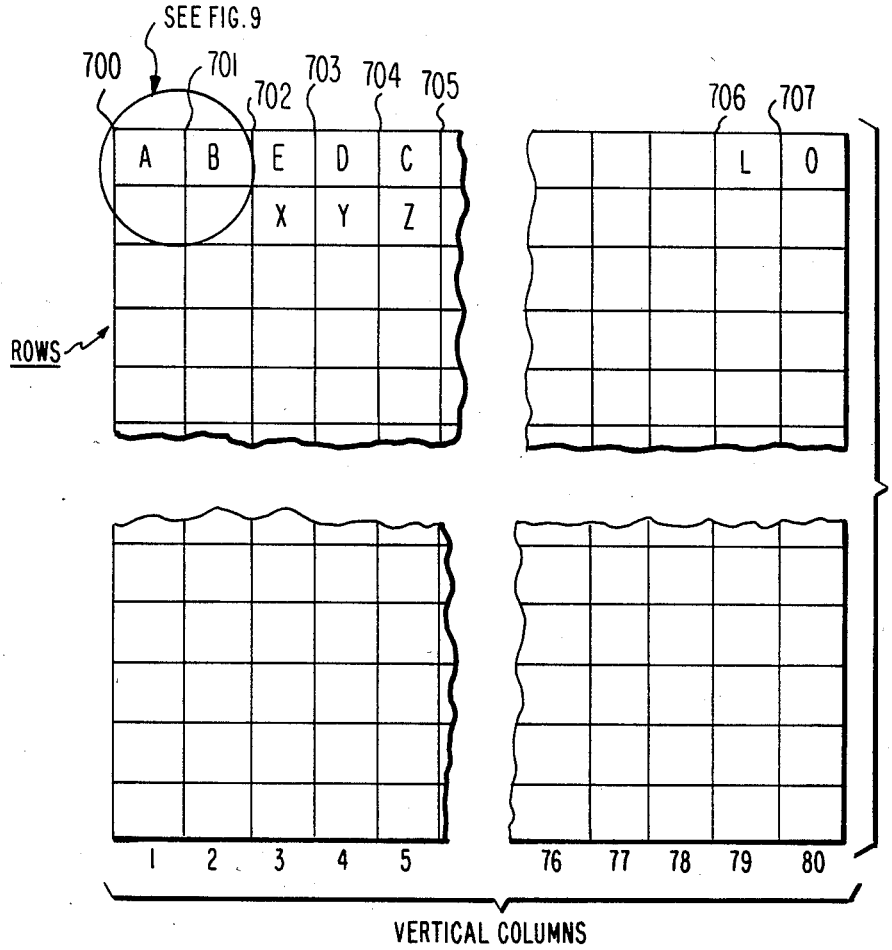

The foregoing can be seen more clearly from FIGS. 8 and 9. In FIG. 8, the address of the upper left hand pixels 700–707 of the characters A, B, E, D, C,—L and O, across the X axis of the display screen are contained in memory locations in the main RAM 108 of FIG. 1. As each of these addresses is accessed from word locations in the main RAM 108 and supplied as an address to ROM 528 of FIG. 7, a 6-bit word is accessed from the addressed word location of ROM 528. This 6-bit word represents six pixels of the particular character being accessed. If the address accessed from the main RAM 108 (FIG. 1) identifies the upper left hand pixel 700 in FIGS. 8 and 9, then it can be seen from FIG. 9 that the first (or top) 6-bit word accessed from ROM 528 will be all blanks since the row of pixels forming the top line of the 6×10 pixel area representing the letter A do not fall in the 5×8 pixel area actually representing the letter A.

The contents of the next accessed word location of main RAM 108 of FIG. 1 will identify that word in ROM 528 whose first pixel corresponds to pixel 701 of FIGS. 8 and 9. Thus, the second 6-bit byte accessed in ROM 528 will be a 6-bit byte beginning at pixel 701 of FIG. 9 and extending to the right in FIG. 9 for 6 pixel spaces. All of these pixels will also be blank since the letter B actually begins on the second row of the ten rows of pixels defining the vertical span of the letter B.

This process will continue so that the 80 character length top line, each comprising six pixels, will also be displayed for the letters E, D, C and the remainder of the 80 characters across the screen including the letters L, O, as shown in FIG. 8.

The logic within dotted block 516 will then function to access the second horizontal row of 6-bit bytes for the 80 characters A, B, E, D, C—L, O, as shown in FIG. 8. It can be seen that this second group of 80 6-bit bytes will contain the rows of pixels actually forming the tops of the letters A and B, as shown in FIG. 9. The foregoing process continues until all ten vertically arranged rows of pixels which form the row of complete characters, as shown in FIG. 8, are displayed on the screen.

It is to be understood that the word locations of ROM 528 are organized such that the ten 6-bit bytes forming any single character are consecutively arranged in the ROM 528. Accumulator 654 and adder 656 cooperate with the character defining addresses stored in ROM 528 to provide for successively scanning the 10 consecutive 6-bit bytes for each selected character. More specifically, accumulator 654 is incremented by one each time counter 602 counts to 80. It is to be noted that accumulator 654 is initially set to zero at the end of the completion of the generation of each horizontal row of characters in response to the resetting of flip-flop 606 by the count of ten of counter 604.

Accumulator 654 will thus accumulate a count which is instantaneously equivalent to the particular vertical line of the ten vertical lines required to generate a character. The value in accumulator 654 is supplied to adder 656 along with the accessed character defining address stored in RAM 600 so that the output of adder 656 is always an updated address causing the words accessed from ROM 528 to sequence through the ten horizontal lines making up a row of 80 characters.

Consider now in detail how the addresses defining the characters stored in ROM 528 become stored in auxiliary RAM 600. When in the mode employing ROM 528 the MUX 524 will route the output of buffer 300 (FIG. 7) through MUX 524 to the data input of ROM 528 and to the data input of auxiliary RAM 600. It will be noted that the first 80 addresses from the main RAM 108 of FIG. 1 are supplied through buffer 300 and into the auxiliary RAM 600 and also into the ROM 528. As mentioned above, RAM 600 will thereafter act as a source of the addresses for ROM 528 for the remaining nine lines required to complete the generation of a row of characters.

The foregoing occurs as follows. At the beginning of the operation of the ROM mode, counters 604 and 602 are reset to zero by the output of switching signal source 522 which is also supplied through OR gate 640 to the enable input 519 of buffer 300. It will be understood that the state (level) of switching signal source 522 is under control of the CPU 100 of FIG. 1 which will simultaneously access the specific word location in RAM 108 whose contents point to an address in ROM 528 containing the first line of the beginning character of a particular horizontal row of characters to be generated in the ROM mode.

The memory request signals are generated at the outputs of AND gates 422 and 424 (FIG. 7) in a manner described above with respect to FIG. 4, and are supplied through OR gate 603 and MUX 601 (when in the ROM mode) to the input of counter 602. Counter 602 responds thereto to iteratively cycle through its count of 80. At each count of 80 counter 604 will advance one count from its original reset-to-zero condition. The output count of 80 of counter 602 is also supplied to the input of accumulator 654 to increment its originally reset-to-zero condition by one for the purposes described above.

When counter 604 registers the count of one at the first count of 80 of counter 602, flip-flop 606 will become set to perform a number of functions. Firstly, the set condition of flip-flop 606, which is a high level signal, will inhibit AND gate 629 so that no further memory request signals will be supplied to RAM 108 of FIG. 1. The reason that no further memory request signals are required is that the auxiliary RAM 600 will assume the responsibility of providing the proper addresses to ROM 528 after the first 80 memory locations are accessed from the main memory 108 (RAM) of FIG. 1. It can be seen that during the first 80 counts of counter 602, flip-flop 606 will be in a reset condition from the count of ten of counter 604 of the previous generation of a horizontal line of characters.

When flip-flop 606 is reset AND gate 629 will become primed so that the output of OR gate 603, which consists of memory request signals, is supplied through MUX 601, lead 629, primed AND 629, and OR gate 654 to the main memory 108 and associated logic of FIG. 1. Thus, 80 memory requests are initially supplied to the main memory logic of FIG. 1 and the contents of the 80 accessed word locations of RAM 108 are received back through buffer 300, which is enabled only during the first 80 counts of counter 602 as discussed above. Also during the first 80 counts of counter 602, when flip-flop 606 is in a reset condition, the write-in logic of RAM 600 is activated via inverter 610 and write enable input 615 so that RAM 600 can accept the first 80 bytes supplied from the main RAM 108 of FIG. 1 via buffer 300 (FIG. 7), MUX 524, and data input terminal 616.

It will be noted that the first 80 bytes of data received from main RAM 108 of FIG. 1 are also supplied through MUX 524 and OR gate 526 to the data input of ROM 528 of FIG. 7.

At the count of one of counter 604, flip-flop 606 will become set, thereby disabling AND gate 629 to prevent further memory request signals from being supplied back to the main RAM 108 of FIG. 1. The setting of flip-flop 606 also disables the write enable logic of RAM 600 through inverter 610 and enables the read logic of RAM 600 via input 608.

In response to clock pulses which are supplied to clock input 614 of RAM 600 from the output of OR gate 603 and MUX 601, RAM 600 will now function to repeatedly read out the 80 addresses stored therein which represent the 80 characters to be displayed horizontally across the CRT screen of the system.

The read-out of the 80 addresses stored in RAM 600 will continue for each 80 count capacity of counter 602. However, during the next nine capacity counts of counter 80 the flip-flop 606 will be set so that RAM 600 will read out the 80 addresses stored therein into ROM 528 through adder 656 and OR gate 526. As discussed above, accumulator 654 and adder 656 will increment by one the address for each character in ROM 528 for each successive horizontal scan of the display.

In the 80 character direct mode of operation (as opposed to the ROM mode) the output signal of switching signal source 522 causes MUX 601 to route the output of OR gate 603 directly through OR gate 654 via lead 607 and then to the memory 108 logic of FIG. 1. In the direct mode of operation MUX 524 passes the output from buffer 300 directly through OR gate 534 via bus 657 to registers A and B of FIG. 6 in the manner described hereinbefore. No data is supplied through MUX 524 to the data input 616 of RAM 600 in the direct mode of operation.

What is claimed is:

1. In a system having: a visual display means; memory means including a random access memory responsive to a train of clock pulses for reading serially therefrom respective N-bit words, where each bit is used to represent a pixel on said display means; a resident timing system for supplying a first train of clock pulses at a first repetition rate and a second train of clock pulses at a second repetition rate; and control means coupled to said memory means: (a) responsive to said first train of clock pulses for causing said memory means to read words serially to said control means at said first rate and (b) responsive to said second train of clock pulses for serially arranging the bits of each word read from said memory, in order to present on said visual display means a given number (X) of pixels per scan;

the improvement comprising:

a circuit which multiplies by a factor M the rate of pixel generation and the number of pixels per display scan without changing the rates at which said resident timing system produces said first and second pulse trains, and which comprises:

a source of a third train of clock pulses at a third repetition rate which is M times the repetition rate of pulses in said second clock pulse train;

generating means responsive to said third train of clock pulses for generating a fourth train of clock pulses having a repetition rate which is a multiple M of the repetition rate of pulses in said first clock pulse train;

switching means for transferring said memory means from connection to said first pulse train produced by said resident timing system to connection to said fourth train of clock pulses produced by said generating means, in order to read words from said memory at a rate which is M times the first rate; and shift register means (a) for receiving in a parallel manner each N-bit pixel-representing data word read from said memory and (b) responsive to said third train clock pulses for serially shifting at said third rate the N-bits of each data word placed therein to a circuit output thereof, in order to produce at said circuit output M times the given number of bits for use in a display scan.

2. The circuit of claim 1, wherein:

said shift register means comprises first and second shift registers and second switching means;

said second switching means includes means for admitting to one of said first and second registers, in alternation, each of the words read successively from said memory; and said second switching means also includes means for supplying to a shift input of the other one of said shift registers a train of N successive clock pulses taken from said third train of clock pulses; and said shift register means further includes multiplexing means for admitting signals shifted from outputs of respective registers to said circuit output.

3. The circuit of claim 1, wherein said second train of pulses has a rate eight times that of said first train of pulses, the factor M is two, and N is eight.

* * * * *